US005582321A

United States Patent [19]

Urbanczyk

[11] Patent Number: 5,582,321

[45] Date of Patent: Dec. 10, 1996

[54] BEVERAGE CAN HOLDING DEVICE

[76] Inventor: Kenneth D. Urbanczyk, 27041 S. Hill, New Hudson, Mich. 48165

[21] Appl. No.: 577,138

[22] Filed: Dec. 22, 1995

[51] Int. Cl.[6] ..... B65D 25/36

[52] U.S. Cl. ..... 220/739; 220/742; 220/626; 220/756

[58] Field of Search ..... 220/739, 741, 220/742, 903, 902, 626, 737, 753, 755, 756

[56] References Cited

U.S. PATENT DOCUMENTS 4,540,611 9/1985 Henderson ..... 220/739
4,735,333 4/1988 Lay et al. ..... 220/739
4,927,047 5/1990 Stuber et al. ..... 220/903
5,054,638 10/1991 Rose ..... 220/741
5,058,757 10/1991 Proa ..... 220/739

*Primary Examiner*—Stephen J. Castellano

[57] ABSTRACT

A beverage can holding device includes a foam-insulated containment portion dimensioned for receipt of a beverage can therein. The device includes a handle having a generally C-shaped configuration. The handle has an upper end portion having a recess formed therein. The recess is adapted for receiving a lip of a beverage can therein. The handle has a lower end portion extending within the containment portion. The lower end portion has a clip extending outwardly therefrom for coupling with a lower end of a beverage can.

1 Claim, 3 Drawing Sheets

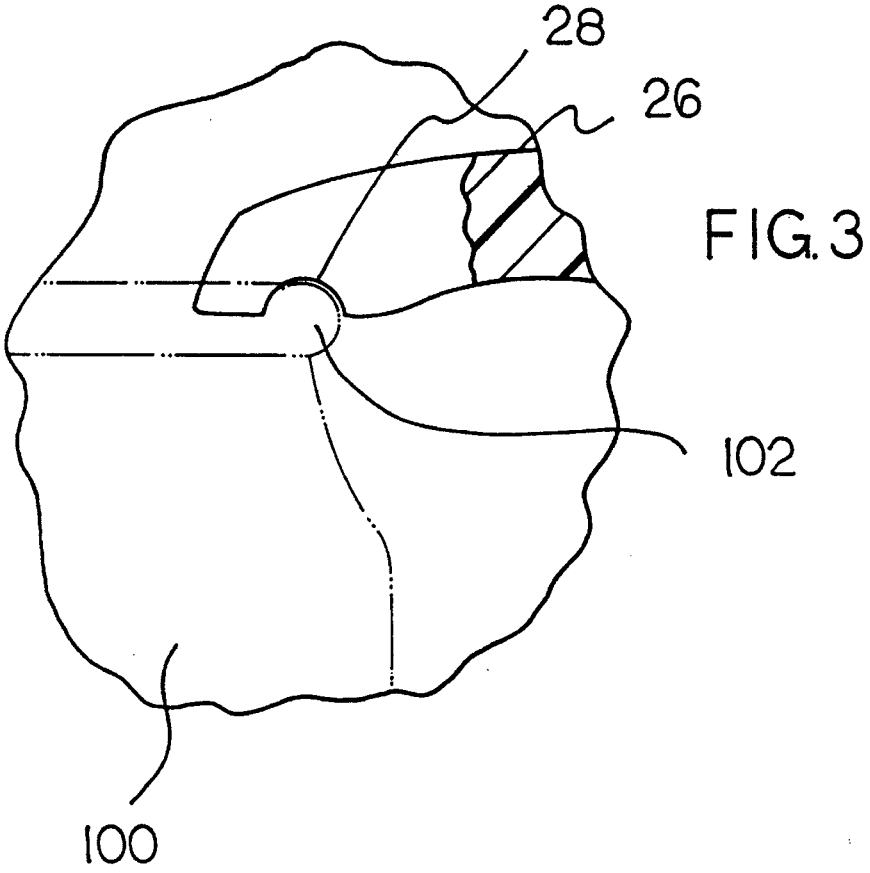
FIG. 3
FIG. 4
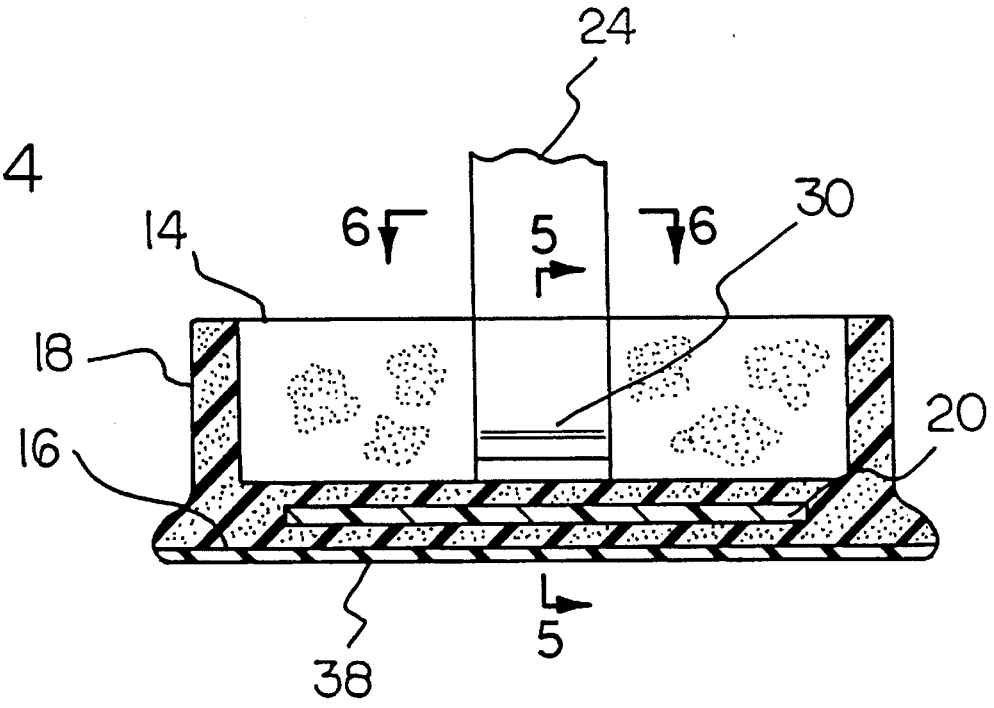

BEVERAGE CAN HOLDING DEVICE

BACKGROUND OF THE INVENTION

1. Field of the Invention

The present invention relates to a beverage can holding device and more particularly pertains to coupling with a beverage can to provide insulation and handling capabilities with a beverage can holding device.

2. Description of the Prior Art

The use of can holders is known in the prior art. More specifically, can holders heretofore devised and utilized for the purpose of holding cans are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,898,297 to Wheeler discloses a detachable handle and coaster for a beverage container.

U.S. Pat. No. 4,993,675 to Walker discloses a can caddy.

U.S. Pat. No. 4,299,366 to Kurzius discloses a can holder.

U.S. Pat. No. 4,654,274 to DeMars discloses a reusable cup holder.

U.S. Des. No. 254,417 to DeMars et al. discloses the ornamental design for a detachable handle for a beverage can or the like.

U.S. Des. No. 303,336 to Webster discloses the ornamental design for a handle for a beverage container.

While these devices fulfill their respective, particular objective and requirements, the aforementioned patents do not describe a beverage can holding device for coupling with a beverage can to provide insulation and handling capabilities.

In this respect, the beverage can holding device according to the present invention substantially departs from the conventional concepts and designs of the prior art, and in doing so provides an apparatus primarily developed for the purpose of coupling with a beverage can to provide insulation and handling capabilities.

Therefore, it can be appreciated that there exists a continuing need for new and improved beverage can holding device which can be used for coupling with a beverage can to provide insulation and handling capabilities. In this regard, the present invention substantially fulfills this need.

SUMMARY OF THE INVENTION

In the view of the foregoing disadvantages inherent in the known types of can holders now present in the prior art, the present invention provides an improved beverage can holding device. As such, the general purpose of the present invention, which will be described subsequently in greater detail, is to provide a new and improved beverage can holding device and method which has all the advantages of the prior art and none of the disadvantages.

To attain this, the present invention essentially comprises a foam-insulated containment portion having an open upper end, a closed lower end, and a cylindrical side wall therebetween. The closed lower end has a diameter greater than a diameter of the open upper end. The closed lower end has a rigid member latitudinally disposed therein. The rigid member has a length about ⅔ a length of the closed lower end. The open upper end is dimensioned for receipt of a beverage can therein. The device includes a handle having a generally C-shaped configuration. The handle has an upper end portion having a recess formed therein. The recess is adapted for receiving a lip of a beverage can therein. The handle has a lower end portion extending within the cylindrical side wall of the containment portion to couple with the rigid member within the closed lower end of the containment portion. The lower end portion has a clip extending outwardly therefrom for coupling with a lower end of a beverage can. The upper end portion has an arcuate portion extending outwardly therefrom. A lower pad is secured to the closed lower end of the foam-insulated containment portion.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved beverage can holding device which has all the advantages of the prior art can holders and none of the disadvantages.

It is another object of the present invention to provide a new and improved beverage can holding device which may be easily and efficiently manufactured and marketed.

It is a further object of the present invention to provide a new and improved beverage can holding device which is of durable and reliable construction.

An even further object of the present invention is to provide a new and improved beverage can holding device which is susceptible of a low cost of manufacture with regard to both materials and labor, and which accordingly is then susceptible of low prices of sale to the consuming public, thereby making such a beverage can holding device economically available to the buying public.

Still yet another object of the present invention is to provide a new and improved beverage can holding device which provides in the apparatuses and methods of the prior art some of the advantages thereof, while simultaneously overcoming some of the disadvantages normally associated therewith.

Even still another object of the present invention is to provide a new and improved beverage can holding device for coupling with a beverage can to provide insulation and handling capabilities.

Lastly, it is an object of the present invention to provide a new and improved beverage can holding device includes a foam-insulated containment portion dimensioned for receipt of a beverage can therein. The device includes a handle having a generally C-shaped configuration. The handle has an upper end portion having a recess formed therein. The recess is adapted for receiving a lip of a beverage can therein. The handle has a lower end portion extending within the containment portion. The lower end portion has a clip extending outwardly therefrom for coupling with a lower end of a beverage can.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a side view of the recessed upper end of the handle.

FIG. 4 is a cross-sectional view as taken along line 4—4 of FIG. 2.

The same reference numerals refer to the same parts through the various Figures.

DESCRIPTION OF THE PREFERRED EMBODIMENT

Figure 1:
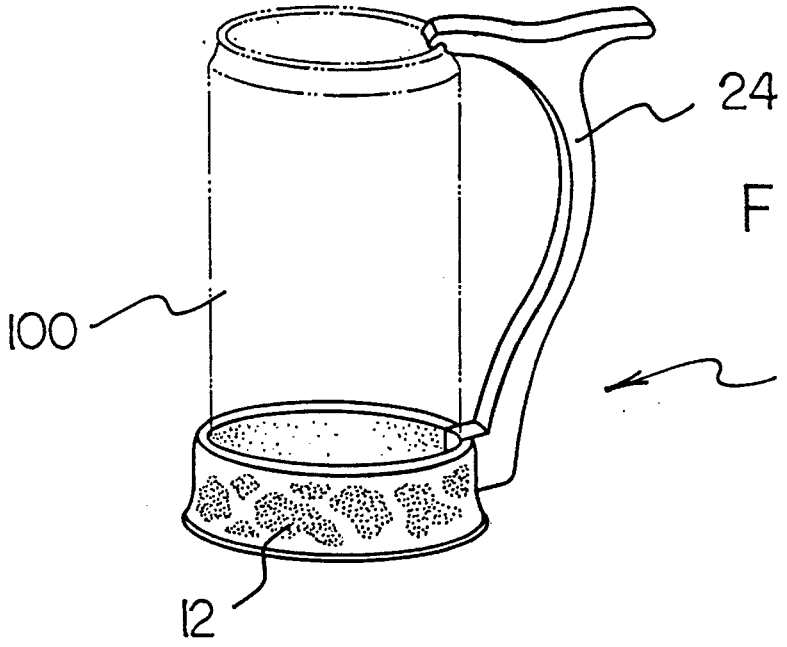
FIG. 1 is a perspective view of the preferred embodiment of the beverage can holding device constructed in accordance with the principles of the present invention.
Figure 2:
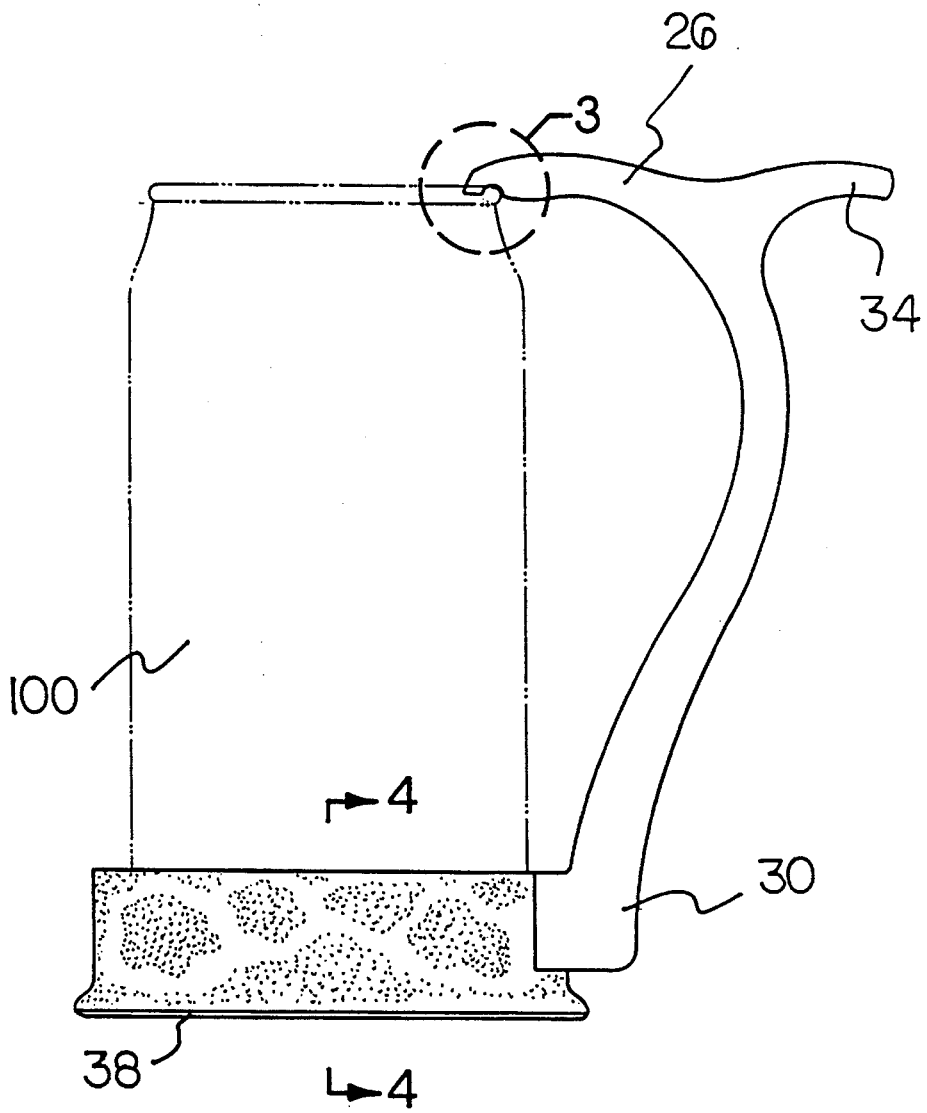
FIG. 2 is a side elevation view of the present invention.
Figure 5:
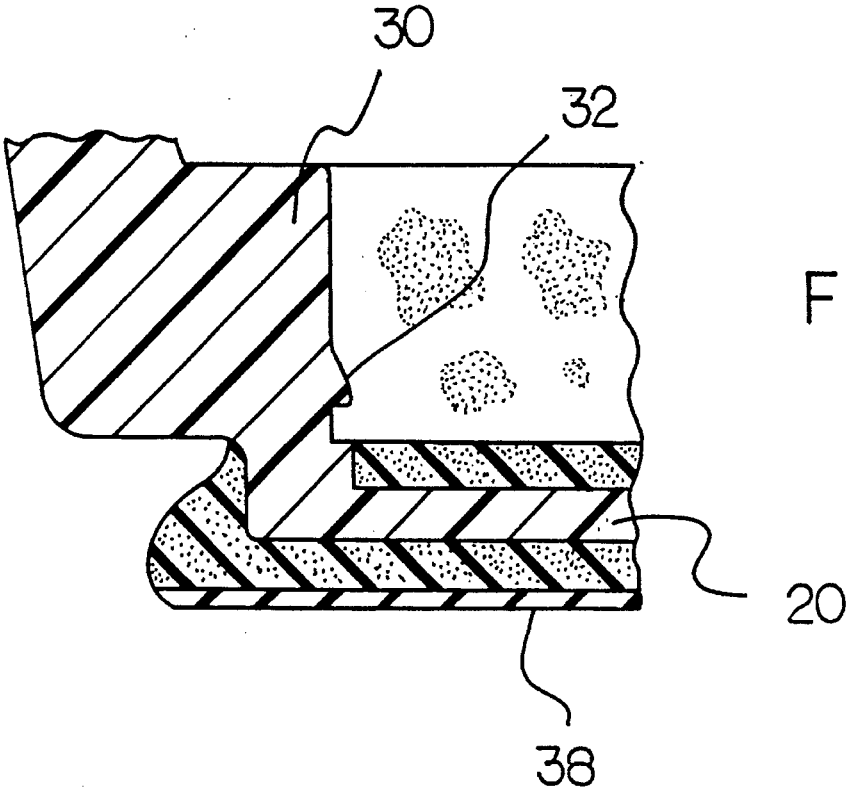
FIG. 5 is a cross-sectional view as taken along line 5—5 of FIG. 4.
Figure 6:
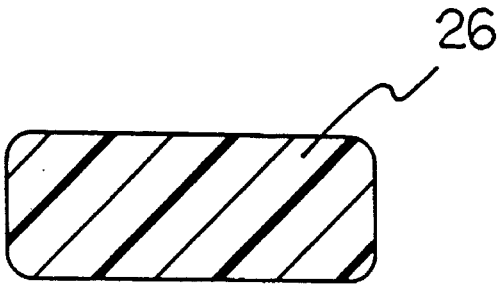
FIG. 6 is a cross-sectional view as taken along line 6—6 of FIG. 4.

With reference now to the drawings, and in particular, to FIGS. 1–6 thereof, the preferred embodiment of the new and improved beverage can holding device embodying the principles and concepts of the present invention and generally designated by the reference number 10 will be described.

Specifically, it will be noted in the various Figures that the device relates to a new and improved beverage can holding device for coupling with a beverage can to provide insulation and handling capabilities. In its broadest context, the device consists of a foam-insulated containment portion, a handle and a lower pad. Such components are individually configured and correlated with respect to each other so as to attain the desired objective.

The device 10 includes a foam-insulated containment portion 12 having an open upper end 14, a closed lower end 16, and a cylindrical side wall 18 therebetween. The closed lower end 16 has a diameter greater than a diameter of the open upper end 14. The greater diameter of the closed lower end 16 provides stability to the device 10 once a beverage can 100 is received therein. The greater diameter of the closed lower end 16 will prevent the containment portion 12 from accidentally falling over. The closed lower end 16 has a rigid member 20 latitudinally disposed therein. The rigid member 20 has a length about ⅔ a length of the closed lower end 16. The open upper end 14 is dimensioned for receipt of a beverage can 100 therein. The foam-insulated containment portion 12 provides the ability to absorb excess condensation produced by the beverage can 100. The containment portion 12 also helps to maintain the cold temperature desired of cold beverages.

The device 10 includes a handle 24 having a generally C-shaped configuration. The handle 24 has an upper end portion 26 having a recess 28 formed therein. The recess 28 is adapted for receiving a lip 102 of a beverage can 100 therein. The handle 24 has a lower end portion 30 extending within the cylindrical side wall 18 of the containment portion 12 to couple with the rigid member 20 within the closed lower end 16 of the containment portion 12. The lower end portion 30 has a clip 32 extending outwardly therefrom for coupling with a lower end of a beverage can 100. The upper end portion 26 has an arcuate portion 34 extending outwardly therefrom. The arcuate portion 34 serves to curve around an upper portion of a user's hand once the user grasps the handle 24 to prevent the device 10 from slipping out of the user's hand.

Lastly, A lower pad 38 is secured to the closed lower end 16 of the foam-insulated containment portion 12. The lower pad 38 is preferably fabricated of a felt material that will protect surfaces that the device 10 is placed upon as well as preventing the device 10 from sliding.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the U.S. is as follows:

1. A beverage can holding device for coupling with a beverage can to provide insulation and handling capabilities comprising, in combination:

a foam-insulated containment portion having an open upper end, a closed lower end, and a cylindrical side wall therebetween, the closed lower end having a diameter greater than a diameter of the open upper end, the closed lower end having a rigid member latitudinally disposed therein, the rigid member having a length about ⅔ a length of the closed lower end, the open upper end dimensioned for receipt of a beverage can therein, the containment portion having a height less than ¼ of a length of the beverage can thereby allowing for easy removal of the beverage can therefrom and allowing for indicia on the beverage can to be visualized;

a handle having a generally C-shaped configuration, the handle having an upper end portion having a recess formed therein, the recess adapted for receiving a lip of a beverage can therein, the handle having a lower end portion extending within the cylindrical side wall of the containment portion to couple with the rigid member within the closed lower end of the containment portion, the lower end portion having a clip extending outwardly therefrom for coupling with a lower end of a beverage can, the upper end portion having an arcuate portion extending outwardly therefrom;

a lower pad secured to the closed lower end of the foam-insulated containment portion.

* * * * *